United States Patent [19]

Bauder

[11] 4,346,687

[45] Aug. 31, 1982

[54] FUEL INJECTION SYSTEMS

[75] Inventor: Armin Bauder, Neckarsulm, Fed. Rep. of Germany

[73] Assignee: Audi NSU Auto Union Aktiengesellschaft, Neckarsulm, Fed. Rep. of Germany

[21] Appl. No.: 156,743

[22] Filed: Jun. 5, 1980

[30] Foreign Application Priority Data

Jul. 5, 1979 [DE] Fed. Rep. of Germany ..... 2927110

[51] Int. Cl.[3] ..... F02M 69/00

[52] U.S. Cl. ..... 123/454; 123/516

[58] Field of Search ..... 123/452, 453, 454, 455, 123/514, 516, 461, 460; 277/DIG. 6, 165

[56] References Cited

U.S. PATENT DOCUMENTS

| | | | |
|---|---|---|---|
| 3,831,259 | 8/1974 | Goolas | 277/DIG. 6 |
| 4,075,995 | 2/1978 | Kramer | 123/453 |
| 4,154,203 | 5/1979 | Peters | 123/452 |
| 4,227,502 | 10/1980 | Steinwart | 123/452 |
| 4,252,331 | 2/1981 | Siegel | 277/165 |
| 4,266,571 | 5/1981 | Bauder | 123/455 |

FOREIGN PATENT DOCUMENTS

| | | | |
|---|---|---|---|
| 2703722 | 8/1978 | Fed. Rep. of Germany | 123/455 |

*Primary Examiner*—Charles J. Myhre
*Assistant Examiner*—Carl Stuart Miller
*Attorney, Agent, or Firm*—Kane, Dalsimer, Kane, Sullivan and Kurucz

[57] ABSTRACT

This invention relates to a fuel injection system.

The fuel injection system has a fuel proportioning valve (3,4) which is supplied by a fuel feed line (39). The fuel proportioning valve supplies fuel to fuel injection valves (not shown) via a diaphragm valve 25. A differential pressure regulator 35 is provided to alter the pressure in the system in accordance with engine parameters. The pressure in the system is controlled by system pressure valve 41.

In operation excess fuel is returned to fuel tank 70. When the engine is switched off a stop valve 63 closes the return line and valve 25 is closed in response to a drop in pressure in the differential pressure regulator 35, thus sealing the system and maintaining the pressure within the fuel supply part of the system to facilitate easy restarting. Seals 73 are provided in the fuel proportioning valve (3,4) to prevent fuel leakage from the seal part of the system between the valve 3 and valve cylinder 4 of the fuel proportioning valve.

7 Claims, 3 Drawing Figures

FUEL INJECTION SYSTEMS

The invention relates to a fuel injection system.

Fuel injection systems are known in which fuel vapour bubbles may form after the engine has been switched off. These bubbles make re-starting of a warm engine considerably more difficult if, within a period of time the pressure drops below a certain level. It has been shown, for example, that the fuel pressure after the engine is switched off can drop in an undesirable way if the fuel is introduced under pressure into the cylindrical space between the bearings of a piston valve cylinder like system, as a result of the drop in pressure between this cylindrical space and outside the bearings, and in spite of the narrowest gap between the precisely formed piston valve cylinder and the piston valve, is able to escape from this gap. Maintenance of the pressure is also difficult because small quantities of fuel may escape via the valve seat of the diaphragm valve when the diaphragm is bruised, and because the formation of vapour bubbles may extend into the system via this valve seat. Lowering of the fuel pressure may, however, also occur via the valve orifice of the differential pressure regulating valve which is connected to the return pipe. In order to overcome these difficulties, it is known for an auxiliary fuel store to be located in the fuel injection system, so that the pressure can be maintained even when the engine is switched off.

It is also known for a stop valve to be located in the common return pipe of the fuel injection system. This stop valve is constructed as a solenoid valve and shuts off the return pipe when the engine is switched off. Leakage cannot occur at the fuel proportioning valve, for example, in the case of this system, as the proportioning valve is actuated by the air quantity metering member via a magnetic device. Magnetic devices of this type are, however, relatively costly and are inferior in regard to the accuracy of the fuel proportioning, in which a positive connection is provided.

According to the present invention there is provided a fuel injection system for a mixture-compressing spark ignition internal combustion engine with continuous fuel injection having a fuel proportioning valve actuable by an air metering member, which is located in the intake manifold of the engine, for proportioning fuel at a pressure difference which is constant but can be varied in accordance with running parameters of the engine, and which has a piston valve which is mounted in a piston valve cylinder by two spaced cylindrical bearings, which piston valve can be moved by the air quantity metering member relative to the piston valve cylinder, such that fuel is introduced under pressure in the cylindrical space between the bearings and lower pressure prevails outside at least one bearing, a differential pressure regulating valve for adjusting the pressure difference which can be varied by running parameters, which has two chambers separated from each other by a diaphragm which constitutes a movable valve member, the first chamber being connected to a return pipe via a valve opening which is controlled by the diaphragm, and the second chamber being actuated by the fuel pressure upstream of the proportioning valve, a diaphragm valve, which has two chambers separated from each other by a diaphragm, which diaphragm constitutes a movable valve member for closing a central valve seat in the first of the chambers and which is clamped between two flat surfaces of a valve casing, the first chamber being connected downstream of the proportioning valve and via the valve seat with an injection valve, and the second chamber communicating the first chamber of the differential pressure regulating valve, wherein the fuel proportioning valve has at least one bearing between the piston valve cylinder and the piston valve, an annular groove in which a gasket is located, wherein in the return pipe of the differential pressure regulating valve there is located a stop valve, which is held open in use by the pressure in the second chamber of the differential pressure regulating valve, wherein a system pressure valve is connected upstream of the stop valve by an outlet port to the return pipe and wherein the diaphragm valve has a spring which is supported between the diaphragm and the valve casing to act in a sense which closes the valve seat.

As a result of the proposed arrangement of gaskets in at least one bearing between the piston valve cylinder and the piston valve, fuel is prevented from emerging from the bearings and causing leakage losses. A further advantage of this arrangement is the fact that the fitting tolerance in the bearings between the piston valve cylinder and the piston valve can be extended slightly simplifying manufacture and hence reducing manufacturing costs. The stop valve in the return pipe of the differential pressure regulating valve makes rapid closure of the injection valves after switching off possible. Further, a certain pressure is maintained in the entire system, and drainage of the system is reliably prevented. As the stop valve is held open by the pressure in the second chamber of the differential pressure regulating valve, it is always open during running, and thus no reactions on the differential pressure can occur. Because the system pressure valve is connected by its outlet port to the return pipe, upstream of the stop valve, drainage of the system is not possible even via this outlet. As a result of the arrangement of a spring in the diaphragm valve, the fuel pressure is ultimately prevented from being reduced via the diaphragm valve. Similarly the formation of vapour bubbles which may originate from the injection valve are prevented from being able to penetrate into the system after switching off.

The proposed measures, in contrast to known arrangements, make it possible for the fuel pressure in the system to be fully maintained at a certain level for a considerable length of time after the engine has been switched off. Prevention of the reduction of the fuel pressure thereby makes re-starting of a still warm engine very much easier and also makes it possible to dispense with the use of a fuel store and for the quantity of fuel which is circulating to be considerably reduced. As a result, a more economical and simpler method of construction of the system can be achieved.

The gasket in the fuel proportioning valve can be composed of a flexible O-shaped ring of elastomeric material butting against the floor of the annular groove, and a plastic slide ring which is located radially from the latter and butts against the facing bearing. In this arrangement the O-shaped ring forms a spring element which seals the annular groove and brings the slide ring into hermetically sealing abutments against the bearing. In one preferred embodiment, in which the piston valve is rotatable relative to the piston valve cylinder, such a slight frictional resistance can be produced between the slide ring and the bearing because of the matching of the material and thus the piston valve, after a temporary standstill or a very slight movement relative to the piston valve cylinder, can be rotated without any noticeable static friction. Preferably the slide ring is made of PTFE.

The annular groove can be formed in the piston valve cylinder. Conversely the annular groove may be formed in the piston valve.

The stop valve in the return pipe has a valve body which is spring-loaded in a sense to close the valve and which is connected to a diaphragm which, on the one side, can be actuated by the pressure in the second chamber of the differential pressure regulating valve to act against the spring to open the valve, and on the other side can be actuated by the pressure of the fuel which is conveyed from the first chamber of the differential pressure regulating valve via the valve opening into the return pipe. This produces the advantage that no sealing of the valve stem connecting the diaphragm to the valve body is necessary.

The stop valve can be located in the fuel proportioning valve casing, as a result of which very little additional space is required for the stop valve.

The invention may be performed in various ways and specific embodiments thereof will now be described by way of example, with reference to the accompanying drawings, in which.

Figure 1:
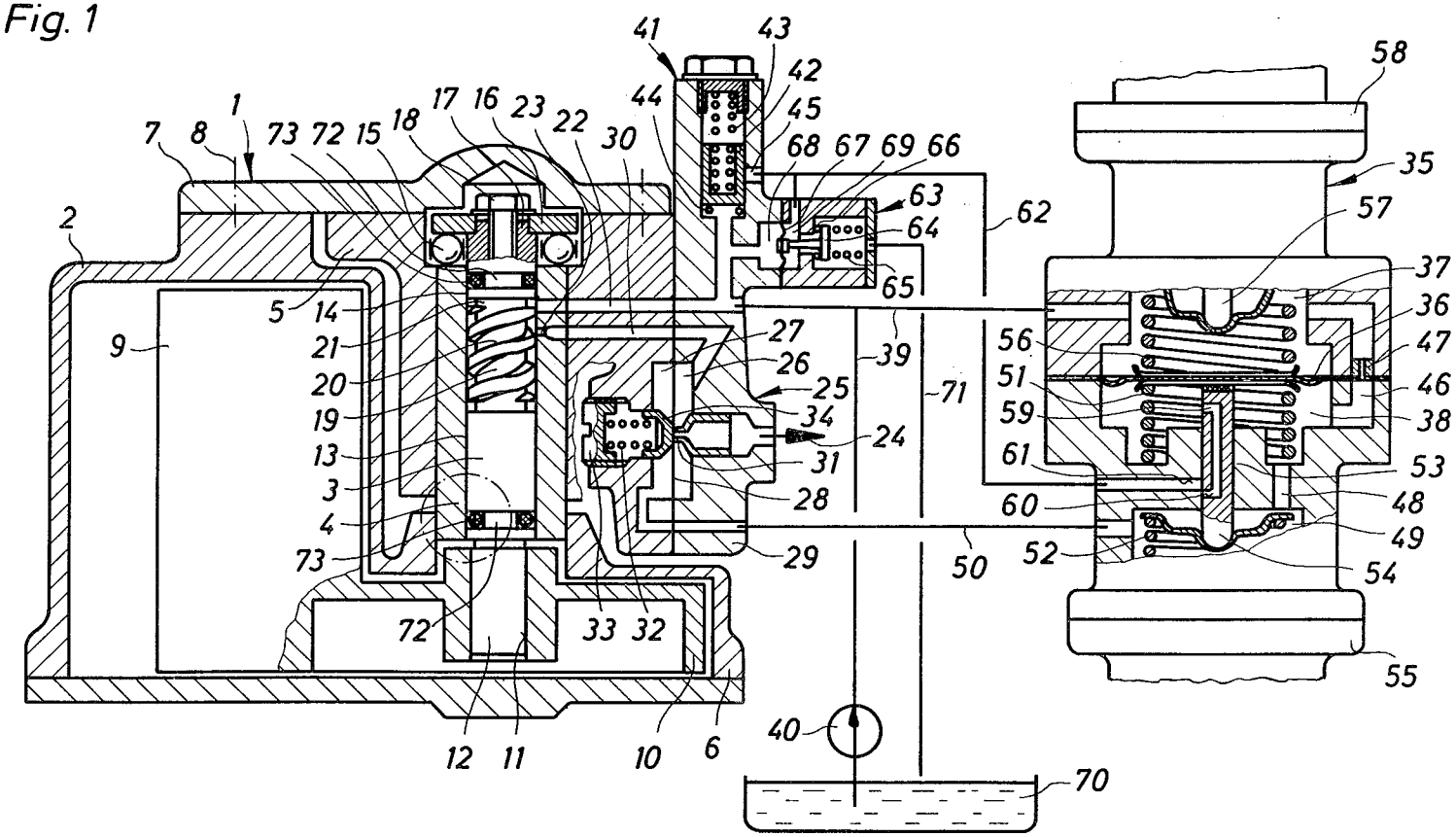
FIG. 1 is a part sectional simplified view of a fuel injection system.

The fuel injection system shown in FIG. 1 has a fuel proportioning valve 1, which is located in the intake manifold 2 of an unillustrated mixture-compressing engine. The fuel proportioning valve 1 in this embodiment is essentially composed of a piston valve 3, which is rotatably mounted in the cylindrical space of a piston valve cylinder 4, the piston valve cylinder 4 being tightly and rigidly inserted in a housing 5 and also in a corresponding bore in a lateral shoulder 6 of the intake manifold 2. The top of the housing 5 is closed by a cover 7, which is connected to the intake manifold 2 by screws 8, one of which is shown diagrammatically. The intake manifold 2 contains a metering member 9, which is designed as a static flap and pivotable in accordance with the quantity of air flowing therethrough. A metering member 9 is laterally mounted by means of an arm 10 which extends into the lateral shoulder 6 of the intake manifold 2. The arm 10 has a bore 11 which receives the bottom end 12 of the piston valve 3 which projects from the piston valve cylinder 4. The end 12 serves as an actuating pin for the metering member 9 and is non-rotatably connected thereto. The rotatable mounting of the piston valve 3 is formed by a lower bearing 13 and an upper bearing 14. The bearings in the piston valve cylinder 4 also constitute the pivotable mounting of the metering member 9. The axial mounting of the piston valve 3 and hence of the metering member 9 is effected by means of an axial ball bearing 15, which is located between the upper end of the piston valve cylinder 4 and a disc 16 which is rigidly connected to the piston valve 3 at the top end 17 by a screw 18. The upper front face of the piston valve cylinder 4 which forms the race of the ball bearing 15, and the bottom front face of the disc 16 are suitably hardened.

The piston valve 3 is formed between its two bearings 13 and 14 with a helical groove 19, which forms a control edge 20 with the outer wall of the piston valve 3. The groove 19 is in communication via an annular groove 21, also formed in piston valve 3, with a fuel inflow passage 22. On the inner wall of the piston valve cylinder 4 are provided feed apertures 23, the number of which corresponds to the number of injection valves 24 which are indicated by arrows, but only one of which is illustrated. The feed apertures 23 cooperate with the helically encircling pilot edge 20 of the piston valve 3 and in each case have a variable throttle cross-section. A diaphragm valve 25 is connected to each feed aperture 23. Each valve has a first chamber 26 and a second chamber 27, which are separated from each other by a diaphragm 28 which acts as a movable valve member and which is clamped between two facing flat surfaces of the housing 5 and a valve casing 29. A valve casing 29, which contains the diaphragm valve 25, is rigidly screwed to the housing 5. The first chamber 26 is connected via a passage 30 to its respective feed aperture 23 and communicates via a central valve seat 31 with its respective injection valve 24. A spring mechanism 32,34 extends into the chamber 27 to act on diaphragm 28. The spring 32 is supported between an adjustable screw plug 33 in the housing 5 and a spring plate 34 butting against the diaphragm 28 and pressing the diaphragm 28 onto the valve seat 31 to close it. Screw plug 33 enables the diaphragm 28 to be held in a tension free state between the flat surface of the housing 5 and casing 29. The screw plug 33 is then screwed in until the desired prestress of the diaphragm is obtained. The screw plug 33 is advantageously sealed against movement in the housing 5 by a gasket which is not shown.

A differential pressure regulating valve 35 belonging to the fuel injection system has two chambers 37 and 38 separated from each other by a diaphragm 36. The chamber 37 is charged with fuel under system pressure by an electrically operated fuel pump 40 via a pipeline 39, while the annular groove 21 in the piston valve 3 of the fuel proportioning valve 1 is charged with fuel under system pressure by the electrically operated fuel pump 40 via a branch originating from the pipeline 39 and via the inflow passage 22. The system pressure is determined by a system pressure valve 41 which is located in the valve casing 29, and which is connected to the inflow passage 22 and has a valve body 42 which is pressed against a valve seat 44 by a spring 43 whose prestress is adjustable. The valve body 42 controls an outflow port 45. The chamber 38 of the differential pressure regulating valve 35 is connected to the chamber 37 via a bypass passage 46 having a throttle 47 disposed therein. Chamber 38 is also connected via passage 48, spring chamber 49 and a pipe 50 to the respective second chamber 27 of each of the diaphragm valves 25.

The diaphragm 36 is actuated by two springs disposed on the chamber 38 side of the diaphragm. The first spring 51 is supported directly between the diaphragm 36 and the housing of valves 35. One end of the second, and partially shown spring 52, abuts against a device 55 which reacts, for example, to load conditions of the engine, whilst its other end abuts against an elongate valve body 54, which extends through a bore 53 into chamber 38 and engages diaphragm 36. A spring 56 is supported with one end engaging the other side of diaphragm 36. The other end of spring 56 engages a cold start adjusting pin 57 which extends into the second chamber 37. Springs 51, 52 and 56, are selected such that spring resistances on the valve body 54 are relieved and hence the body 54 is readily movable within bore 53.

The pressure in the first chamber 38 of the differential pressure regulating valve 35 which determines the differential pressure in the proportioning valve 1, is controlled by the device 55 which reacts to the load state of the engine and by the device 58 for cold start concentration, which act on respective sides of the diaphragm 36 to release the flow cross-section in the valve body 54 to a greater or lesser extent and therefore vary the pressure difference between the chamber 37 and 38. To this end, the valve body 54 has a control orifice 60 connected through a passage 59 to the chamber 38, which orifice cooperates with an outflow port 61, which is located in the wall of the bore 53 and which communicates via a return pipe 62 with a stop valve 63.

The stop valve 63, as can be seen, is also partly formed by the valve casing 29, which is itself screwed to the fuel proportioning valve 1. This arrangement considerably reduces the space requirement for the stop valve 63. Stop valve 63 has a valve member 64, which is pressed tightly against a valve seat 66 by a spring 65 in the rest state. A valve stem connected to the valve member 64 is fastened to a diaphragm 67, which defines a chamber 68 which is connected to the inlet port 22 and actuated by the system pressure, and a chamber 69 which is connected to the return pipe 62. The chamber 69 is also connected to the system pressure valve 41 via outlet port 45 which opens into the return pipe 62.

In the running state, the system pressure acts against the diaphragm 67, so that the stop valve 63 is held opened and therefore the flow of the fuel emerging from the outlet port 45 of the system pressure valve 41 and from the drainage orifice 61 of the differential pressure regulating valve 35 is released into the return pipe 71, which is connected via the stop valve 63 to the fuel tank 70.

The fuel which is conveyed by the fuel pump 40 from the fuel tank 70 passes under pressure through the pipe 39 not only into the second chamber 37 of the differential pressure regulating valve 35 but also through the inflow passage 22 and the annular groove 21 into the groove 19 of the piston valve 3. Depending upon a quantity of air flowing through the intake manifold 2, the piston valve 3 is rotated by the metering member 9, to which it is connected via the actuating pin 12. Rotation of the piston valve causes pilot edge 20 to vary the throttle cross-section of the feed apertures 23, and an appropriate quantity of fuel is delivered via the feed apertures 23. The fuel passes through the passage 30 into the first chamber 26 of the diaphragm valve 25, from whence it flows through the valve seat 31 to the appropriate injection valve 24.

Piston valve 3 is formed at bearings 13 and 14 respectively with radial annular grooves 72, in which gaskets 73 are disposed, to seal against the piston valve cylinder 4 to prevent fuel, which enters the cylindrical space between piston 3 and cylinder 4 through the annular groove 21 and groove 19 escaping passed bearings 13 and 14 due to the lower pressure existing on the outside of these bearings.

After the engine is switched off, rapid closure of the stop valve 63 occurs, so that drainage of the system via the return pipe 71 is impossible either through the system pressure valve 41 or through the differential pressure regulating valve 35. Similarly, the valve seat 31 of the diaphragm valve 25 remains closed, whereby the fuel pressure is prevented from being reduced via the diaphragm valve 25 or vapour bubble formation originating from the injection valve 24 penetrating into the system. The gaskets 73 which are located in the piston valve 3, reliably maintains the fuel pressure in the then sealed or closed system for a prolonged period of time after the engine is switched off, and re-starting of the engine is made considerably easier.

Figure 2:
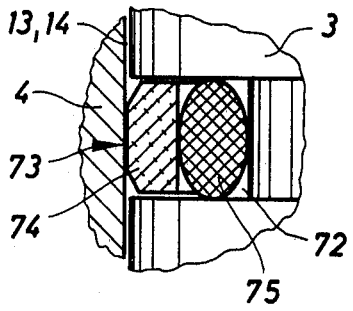
FIG. 2 shows the area enclosed by a dot-dash circle in FIG. 1 on an enlarged scale.

As the enlarged partial view in FIG. 2 shows, the gasket 73, which is located in the piston valve 3, is constituted by a closed slide ring 74 of material with advantageous sliding properties, for example, PTFE, which butts against the facing bearing 13 or 14 in the piston valve cylinder 4, and a closed O shaped ring 75 of elastomeric material which is radially supported between the base of the annular groove 72 and the slide ring 74. Here the slide ring 74 seals the bearings 13 and 14 and the O shaped ring 75 seals the annular groove 72 against the ingress of fuel. The O shaped ring 75 simultaneously presses flexibly radially against the lever collar 74 and keeps the latter in constant slidable abutment against the piston valve cylinder 4. In the case of this arrangement and matching of material, a specially low frictional resistance is obtained, so that no static friction has to be overcome at the point of contact between the slide ring 74 and the bearings when there is a relative movement after a temporary standstill or a very slight rotating movement.

Figure 3:
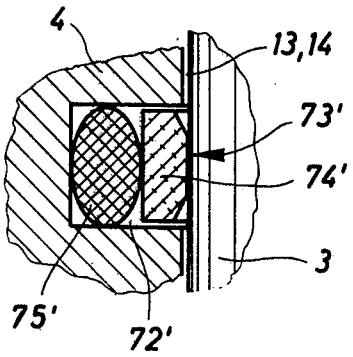
FIG. 3 shows an alternative embodiment of the encircled area in FIG. 1.

In FIG. 3 it can be seen that the gasket 73' is located in the piston valve cylinder 4—in contrast to the embodiment of FIG. 2—and on the facing bearing 13 or 14, butts against the piston valve 3. The gasket 73' is composed of a closed slide ring 74' which butts against the piston valve 3, and a closed O shaped ring 75' of elastomeric material which is supported radially between the floor of the annular groove 72' and the lever collar 74'. The slide ring 74' which, as in the embodiment of FIG. 2, is composed of a material with advantageous sliding properties, for example, PTFE, hermetically seals the bearings 13 and 14, and the O shaped ring 75' hermetically seals the annular groove in the piston valve cylinder 4 against the ingress of fuel. The O shaped ring 75' in this case also, presses flexibly radially against the slide ring 74' and keeps the latter in constant slidable abutment against the piston valve 3.

The invention is not confined merely to the illustrated embodiment. For example, instead of two gaskets in the bearings 13 and 14, only a single gasket 73 or 73' in the lower bearing 13 may be adequate for the hermetic sealing of the fuel proportioning valve 1. Similarly, it is possible for the gaskets to be composed of another material, such as for example, polyamide or fluorehydrocarbon, which likewise have good sliding properties. Within the framework of the invention, operation parameters which are not stated here may act on the valve body 54 of the differential pressure regulating valve 35 in another known way not mentioned here, and be used to control the differential pressure. As already mentioned, there are provided in the piston valve cylinder 4, feed apertures 23, the number of which corresponds to the number of injection valves 24. This means that for a four-cylinder engine with four injection valves, for example, four feed apertures 23 which cooperate with the pilot edge 20 of the piston valve 3, and four diaphragm valves 25 must similarly be provided.

We claim:

1. In a fuel injecting system for a mixture compressing spark-ignition internal combustion engine with continuous fuel injection, having a valve for maintaining a predetermined pressure in the system; means for metering air flowing through the intake manifold of the engine; a fuel proportioning valve, actuable by the air metering means, for proportioning fuel at a pressure difference which is constant but which can be varied by running parameters of the engine, the fuel proportioning valve comprising a rotatable piston valve, a piston valve cylinder, a pair of axially spaced cylindrical bearings for mounting the piston valve in the cylinder to define a space between the valve and the cylinder extending between the bearing; a fuel feed line for introducing fuel under pressure in to said space such that a lower pressure prevails outside at least one bearing; a fuel return line, a differential pressure regulating valve for regulating said pressure difference, comprising body means defining a substantially enclosed space, a diaphragm constituting a movable valve member and extending across the space to define first and second chambers, valve means for connecting the first chamber to the return line, the valve means being operable by the diaphragm, and means for connecting the second chamber to the fuel feed line upstream of the fuel proportioning valve; and a diaphragm valve having a casing defining a substantially enclosed spaced having a valve seat; a diaphragm extending across the space to define two chamber, and acting as a movable valve element for closing the valve seat, the diaphragm being held in the casing between two flat surfaces of the casing, means for connecting the first chamber to the fuel proportioning valve downstream of the fuel proportioning valve, means for connection the first chamber to an injection valve via the valve seat, and means for connecting the second chamber of the diaphragm valve to the first chamber of the differential pressure regulating valve; the improvement comprising one of the piston valve or cylinder defining an annular groove at least one of the bearings and sealing gasket means disposed in the groove to seal against the other of the valve or cylinder; a normally closed stop valve disposed in the return pipe and means for holding the stop valve open when the second chamber of the differential pressure regulating valve is above a predetermined a level; the system pressure valve having an outlet connected to the return pipe upstream of the stop valve; and the diaphragm valve having a spring and means for mounting the spring between the casing and the diaphragm such that the spring acts on the diaphragm to close the valve seat.

2. Fuel injection system as claimed in claim 1, wherein the or each gasket in the fuel proportioning valve is composed of a flexible O shaped ring of elastomeric material butting against the floor of the annular groove and a plastic material slide ring which is located radially from the latter and butts against the facing bearing.

3. Fuel injection system as claimed in claim 2, wherein in that the slide ring is made of polytetrafluorethylene.

4. Fuel injection system as claimed in claim 2 or claim 3, wherein the annular groove with the gasket is located in the piston valve cylinder.

5. Fuel injection system as claimed in claim 1, wherein the stop valve has a valve body disposed in the return line which is spring-loaded in a sense to close the valve and which is connected to a diaphragm, which can be actuated on the one side to act against the spring to open the valve by the pressure in the second chamber of the differential pressure regulating valve, and on the other side by the pressure of the fuel which is conveyed from the first chamber of the differential pressure regulating valve via the valve opening into the return pipe.

6. Fuel injection system as claimed in claim 5, characterised in that the stop valve is located in the casing of the fuel proportioning valve.

7. A fuel injection system for a mixture-compressing spark ignition internal combustion engine with continuous fuel injection having a fuel feed line; a fuel return line; a fuel proportioning valve comprising a piston valve cylinder having an inlet connected to the fuel feed line and at least one outlet; a piston valve element for controlling the rate of flow of fluid through the or each outlet mounted in the cylinder by a pair of spaced cylindrical bearings, a groove formed in one of the cylinder or element at least one of the bearings and sealing gasket means disposed in the groove to seal between the cylinder and element, a differential pressure valve responsive to engine parameters, in use, having first and second chambers separated by a diaphragm, the first chamber being connected to the return line via a valve controlled by the diaphragm, and the second chamber being connected to the fuel feed line; a diaphragm valve for each outlet having first and second chambers separated by a diaphragm, the first chamber being connected to its respective outlet and having an outlet connectable to fuel injection means, resilient means acting on the diaphragm in a sense to urge the diaphragm against the outlet of the first chamber to close that outlet; means for connecting the second chamber of the or each diaphragm valve to the second chamber of the pressure regulating valve; a system pressure valve connected between the fuel feed line and the fuel return line to maintain a predetermined fuel pressure in the system and a normally closed stop valve connected in the return line downstream of the system pressure valve; and means for holding the stop valve open whenever the pressure in the second chamber of the pressure regulating valve is above a predetermined value.

* * * * *